US011504284B2

(12) United States Patent
Campani

(10) Patent No.: US 11,504,284 B2
(45) Date of Patent: Nov. 22, 2022

(54) SPINAL IMMOBILIZATION TABLE

(71) Applicant: NORTHWALL S.R.L., Langhirano (IT)

(72) Inventor: Nicola Campani, Castelnovo Ne' Monti (IT)

(73) Assignee: NORTHWALL S.R.L., Langhirano (IT)

( * ) Notice: Subject to any disclaimer, the term of this patent is extended or adjusted under 35 U.S.C. 154(b) by 210 days.

(21) Appl. No.: 16/590,554

(22) Filed: Oct. 2, 2019

(65) Prior Publication Data

US 2020/0107975 A1 Apr. 9, 2020

(30) Foreign Application Priority Data

Oct. 4, 2018 (IT) ..... 102018000009159

(51) Int. Cl.
*A61G 1/044* (2006.01)
*A61G 1/04* (2006.01)
*A61G 1/048* (2006.01)

(52) U.S. Cl.
CPC ..... *A61G 1/044* (2013.01); *A61G 1/04* (2013.01); *A61G 1/048* (2013.01)

(58) Field of Classification Search
CPC . A61G 1/00; A61G 1/04; A61G 1/044; A61G 1/048; A61G 7/103
See application file for complete search history.

(56) References Cited

U.S. PATENT DOCUMENTS 2,489,828 A * 11/1949 Springer ..... A61G 1/01 5/628
2,519,376 A * 8/1950 Belton ..... B63B 7/082 441/80
3,158,875 A * 12/1964 Fletcher ..... A61G 1/01 5/628
3,463,534 A * 8/1969 Roy ..... D07B 1/148 294/74
3,775,782 A * 12/1973 Rice ..... A61G 1/00 5/625
3,811,433 A * 5/1974 Brachet ..... A61G 1/04 5/628
4,034,748 A * 7/1977 Winner ..... A61F 5/05883 602/19
4,259,950 A * 4/1981 Klippel ..... A61F 5/05883 128/870
4,299,211 A * 11/1981 Doynow ..... A61F 5/05883 128/870
4,601,075 A * 7/1986 Smith ..... A61G 1/044 128/870

(Continued)

*Primary Examiner* — David R Hare
(74) *Attorney, Agent, or Firm* — Pearne & Gordon LLP

(57) ABSTRACT

A spinal immobilization board (1) comprising a support body (2) adapted to support the torso and the head of a person; at least one apical anchoring strap (5) configured to secure the head of the person; and an anchoring belt (9) configured to secure a portion of the torso of the person. The board (1) further comprises a gripping means (11) comprising a first and a second lifting handle (12, 13) that are arranged in a respective perimeter portion of the board (1) and extend outwardly from the board. The first and second lifting handles (12, 13) are active on a portion of the board (1) adapted to be arranged near the armpits of the person in a handling condition of the board (1).

18 Claims, 3 Drawing Sheets

(56) References Cited

U.S. PATENT DOCUMENTS

| | | | | | |
|---|---|---|---|---|---|
| 4,612,678 | A * | 9/1986 | Fitsch | A61G 1/04 | 128/870 |
| 4,655,206 | A * | 4/1987 | Moody | A61G 1/01 | 5/628 |
| 4,736,474 | A | 4/1988 | Moran et al. | | |
| 5,014,374 | A * | 5/1991 | Williams | A61F 5/05883 | 128/870 |
| 5,014,724 | A | 5/1991 | Miller | | |
| 5,016,620 | A * | 5/1991 | Matthews | A61F 5/05883 | 128/870 |
| 5,048,134 | A * | 9/1991 | Dennill | A61F 5/3776 | 5/625 |
| 5,161,275 | A * | 11/1992 | Simpson | A61G 1/017 | 297/219.1 |
| 5,515,867 | A * | 5/1996 | Lamb | A61F 5/3707 | 128/845 |
| 6,227,201 | B1 | 5/2001 | Ferko, III | | |
| 7,360,543 | B1 * | 4/2008 | Coleman | A61F 5/3769 | 128/869 |
| 8,615,829 | B2 * | 12/2013 | Kenalty | A61G 1/044 | 5/628 |
| 9,827,152 | B1 * | 11/2017 | Calkin | A61G 1/01 | |
| 2004/0182644 | A1 * | 9/2004 | Kotarski | A61G 1/044 | 182/3 |
| 2010/0233922 | A1 * | 9/2010 | Cynamon | B63C 9/04 | 441/80 |
| 2012/0284923 | A1 * | 11/2012 | Jensen | A61G 1/04 | 5/627 |
| 2016/0242973 | A1 * | 8/2016 | Delaney | A61G 1/01 | |

* cited by examiner

SPINAL IMMOBILIZATION TABLE

The present invention relates to a spinal immobilization table.

A spinal table or spinal board is a device used for the extrication, immobilisation, collection and brief transfers of people who are trauma victims.

In particular, extrication means an emergency medical rescue procedure that enables a person to be extracted, with suitable instruments, from a vehicle involved in an accident.

The spinal board was conceived to achieve immobilisation and containment of the entire body of a patient with multiple trauma, preserving the alignment of the head, neck and torso.

The device is thus widely used in rescue operations following traumatic incidents, for example road accidents, and in which it is suspected that the person may have suffered spinal column injuries.

In order to ensure safety during rescue operations, a spinal board must have high rigidity so as to maintain its shape also in the presence of high loads due, for example, to the weight of people with a particularly heavy build.

Prior art spinal boards feature a plurality of through openings adapted to define grips for enabling a firm, secure hold of the board by the rescuers. Disadvantageously, during extrication the tight spaces make it particularly difficult for the rescuer to hold on to such grips.

Furthermore, spinal boards can have a multitude of anchoring straps configured to enable the person's head and torso to be secured to the board.

Disadvantageously, the straps adapted to secure the head in place induce torsional stresses on the patient's neck due to the unilateral tensioning they are subjected to in order to obtain the constraint to the spinal board.

The object of the present invention is therefore to provide a spinal immobilization board that allows the handling of a person during rescue procedures to be facilitated.

The stated technical task and specified object are substantially achieved by a spinal immobilization board comprising the features disclosed in one or more of the claims.

The dependent claims correspond to possible embodiments of the invention.

Additional features and advantages of the present invention will be more clearly apparent from the approximate, and thus non-limiting, description of one embodiment of a spinal immobilization board.

This description will be set out below with reference to the appended drawings, which are provided solely for illustrative and therefore non-limiting purposes, in which.

Figure 1:
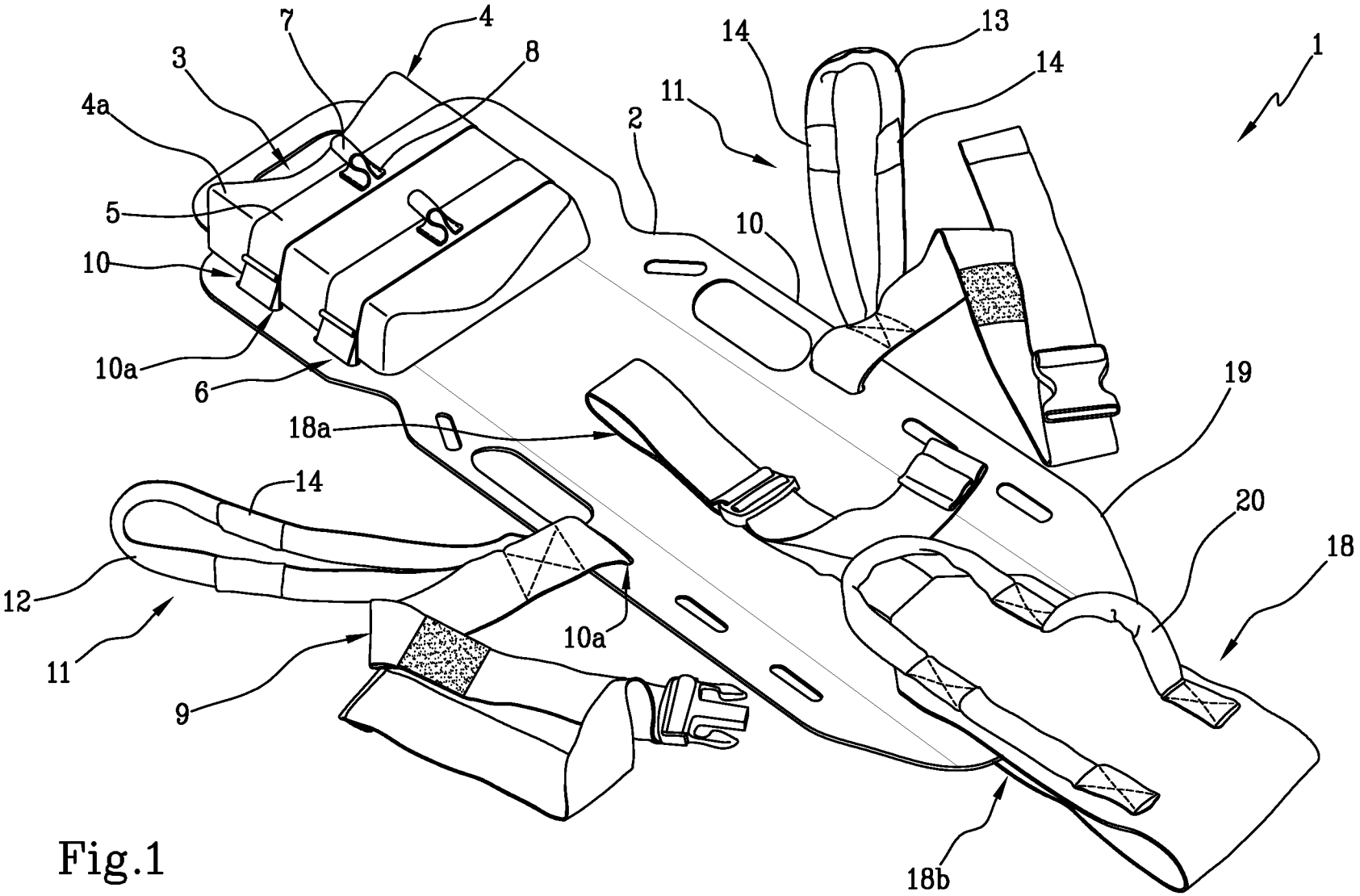
FIG. 1 is a schematic view of a spinal immobilization board in accordance with the present invention.

With reference to the appended figures, the numerical reference 1 denotes in its entirety a spinal immobilization board, hereinafter indicated as board 1 for the sake of simplicity.

The board 1 is a device used to rescue a person in such a way as to obtain immobilization of the body to ensure the alignment of the head, neck and torso.

The board 1 comprises a support body 2 configured to receive restingly and support the torso and the head of a person.

As illustrated in the appended figures, the board 1 can comprise a plurality of gripping portions adapted to enable transport and handling by a user.

In particular, the support body 2 comprises an upper slot 3 defining a grip for handling the board 1.

Upper refers to a portion of the board 1 near the head of the person in a handling condition.

In other words, the upper slot 3 is located in proximity to a portion of the support body 2 adapted to support the head of the rescued person.

Advantageously, besides facilitating the above-mentioned operations of handling and transporting the board 1, the grip ensures the protection of the person's head against accidental impacts that may occur during the rescue procedures.

The board 1 can comprise a padded portion 4 adapted to receive restingly a portion of the body of the rescued person, preferably the head.

In other words, the padded portion 4 defines a sort of supporting pillow for the patient's head during the handling condition.

In particular, the padded portion is configured to receive the head of the person resting on a front surface 4*a*.

The padded portion 4 is preferably made of polymeric material, for example expanded polyurethane.

The padded portion 4 is connectable to the support body 2 in a portion near the upper slot 3.

Furthermore, the padded portion 4 can be connected to the board 1 with generic connecting means, preferably tear-off.

The board 1 comprises at least one apical anchoring strap 5 configured to secure the person's head.

Said apical strap 5 defines a first locking point P located on the head of the person.

The apical anchoring strap 5 is made of elasticized material, for example: elastic silicone, adapted to make known the force applied for compression corresponding to the different cranial diameters.

Advantageously, the apical anchoring strap 5 is reversibly configurable between a rest configuration and an elongated configuration in which it adapts to the person's head by changing its length so as to firmly secure the latter.

In accordance with a possible embodiment of the present invention, the board 1 comprises a tear-off connecting means 6 that is active between the apical anchoring strap 5 and the padded portion 4 so as to connect the padded portion 4 to the support body 2.

Said tear-off connecting means 6 is preferably active on a rear surface 4*b* of said padded portion 4 opposite said front surface 4*a*.

The board 1 can comprise a ribbon-shaped element 7 connected to a preferably central portion of the apical anchoring strap 5 so as to form a gripping element, preferably a slot, for a user.

In particular, the user grasps the ribbon-shaped element 7 to move the apical anchoring strap 5 in order to position it correctly to secure the head of the rescued person.

Furthermore, the ribbon-shaped element 7 and the apical anchoring strap 5 are operatively connected so as to indicate a state of tension of the apical anchoring strap 5.

In accordance with a possible embodiment, the ribbon-shaped element 7 is constrained to the apical anchoring strap 5 by means of two rows of stitches 8 parallel to each other and perpendicular to the main direction of extension of the apical anchoring strap 5.

As illustrated in FIG. 1, the ribbon-shaped element 7 is constrained at a first and second end to the apical anchoring strap 5 by means of respective rows of stitches 8 perpendicular to the direction of elongation of the apical anchoring strap 5.

In particular, the rows of stitches 8 are reciprocally arranged at a preset distance "D".

In this manner, a change in the length of the apical anchoring strap 5 causes a variation in the above-mentioned distance "D".

Advantageously, the distance "D" is evaluated, preferably measured, by the user to determine the degree of tension of the apical anchoring strap 5 and the resulting action of that tension on the head of the person.

According to the particular embodiment illustrated in the appended figures, the board 1 comprises two apical anchoring straps 5 arranged parallel and respectively comprising a ribbon-shaped element 7.

In accordance with possible alternative embodiments not illustrated in the appended figures, the ribbon-shaped element 7 may not be present, without the inventive concept of the present invention being altered.

The board 1 further comprises at least one anchoring belt 9 configured to secure a portion of the person's torso.

Advantageously, the anchoring belt 9 enables a secure immobilization of the patient on the board 1 to limit the risk of injuries to the spinal column during the rescue procedures.

As illustrated in the appended figures, the anchoring belt 9 and/or the apical anchoring strap 5 have respective connecting means 10 adapted to connect them to a respective portion of the support body 2.

In particular, the support body 2 comprises at least one coupling seat 10*a* and the above-mentioned connecting means 10 comprise at least one buckle adapted to engage reversibly in a respective coupling seat 10*a* to define a shape coupling.

Advantageously, said shape coupling is particularly effective and rapidly implementable.

Advantageously, the apical anchoring strap 5 has respective connecting means 10 at both ends, which are thus stably fixed to the support body 2.

The board 1 comprises a gripping means 11 configured to facilitate rescue operations, for example extrication.

The gripping means 11 comprises a first and a second lifting handle 12, 13 which are arranged in a respective perimeter portion of said board 1 and extend outwardly from the board 1. The first and second lifting handles 12, 13 are preferably produced with flexible straps made of fabric or another similar material.

In particular, the first and second lifting handles 12, 13 are active on a portion of the board near the armpits of the person in a handling condition.

Said gripping means 11, or more specifically said first and second handles 12,13, respectively define a second and a third locking point P', P" located on the armpits of the person.

The aforesaid first, second and third locking points P,P', P", if connected together by three straight lines, define a triangle.

In other words the locking points P,P',P" lie at the vertices of a triangle.

Said triangle subtends a locking (and safety) plane of the patient in space.

In particular, the first and second lifting handles 12, 13 are active respectively on the second and third points P',P" so as to secure the body of the person.

Therefore, the lifting handles 12, 13, besides enabling handling of the board 1, are configured to cooperate actively in securing the person during rescue operations.

In other words, notwithstanding any handling of the board and/or possible impacts on the same, thanks to this precise location of the locking points P,P',P", located on an ideal anatomical triangle defined by the head and armpits, the patient's spinal column is always safe.

In other words, the three locking points and the location thereof allow the patient's spinal column to be isolated irrespective of any handling or impact received by the board 1.

In accordance with the particular embodiment illustrated in the figures, the gripping means 11 is connected to the anchoring belt 9. Each lifting handle 12, 13 is preferably connected to the anchoring belt 9 at a point, in a configuration of use of the board 1, in which the anchoring belt 9 is closed, lies inside the board 1 itself. In other words, each lifting handle 12, 13 is connected to the anchoring belt 9 in a portion of the anchoring belt 9 configured to wrap the torso of the person.

Each lifting handle 12, 13 is preferably connected to the anchoring belt 9 at one end thereof.

Each lifting handle 12, 13 is preferably connected to the anchoring belt 9 in such a way as to be arranged, in a configuration of use of the board 1 in which the anchoring belt 9 is closed, transversal to the anchoring belt 9.

The anchoring belt 9 and each lifting handle 12, 13 preferably comprise respective reversible coupling means 14 so as to define at least a condition of reduced dimensions, wherein the lifting handles 12, 13 are retained on the anchoring belt 9, preferably parallel thereto, and a condition of extended dimensions, wherein the first and second lifting handles 12, 13 are detached from the anchoring belt 9 and are suitable for handling the board 1.

Advantageously, the reversible coupling means 14 enables the gripping means 11 to be maintained in a condition of reduced dimensions so as not to interfere with the rescue operations during positioning of the person on the board 1.

The board 1 preferably comprises a floating means 15 adapted to generate a hydrostatic thrust that is greater than the weight of the board 1, so as to promote floating of the board 1 in water.

The floating means 15 can include passive floating portions, made for example of expanded material, foams or other types of low-density material preferably associated with the support body 2.

Figure 2:
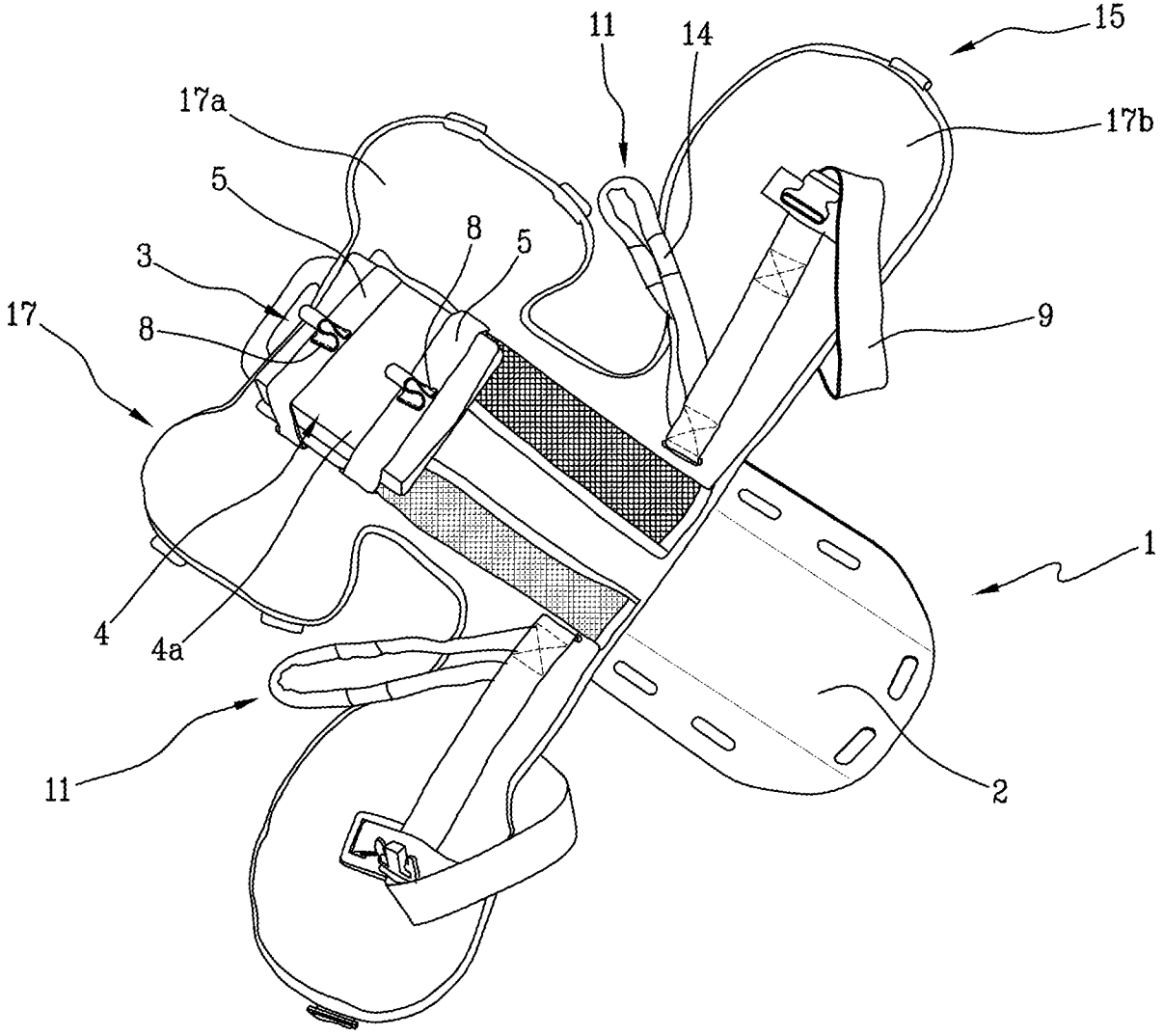
FIG. 2 is a schematic view of a spinal immobilization board in accordance with a possible embodiment.
Figure 3:
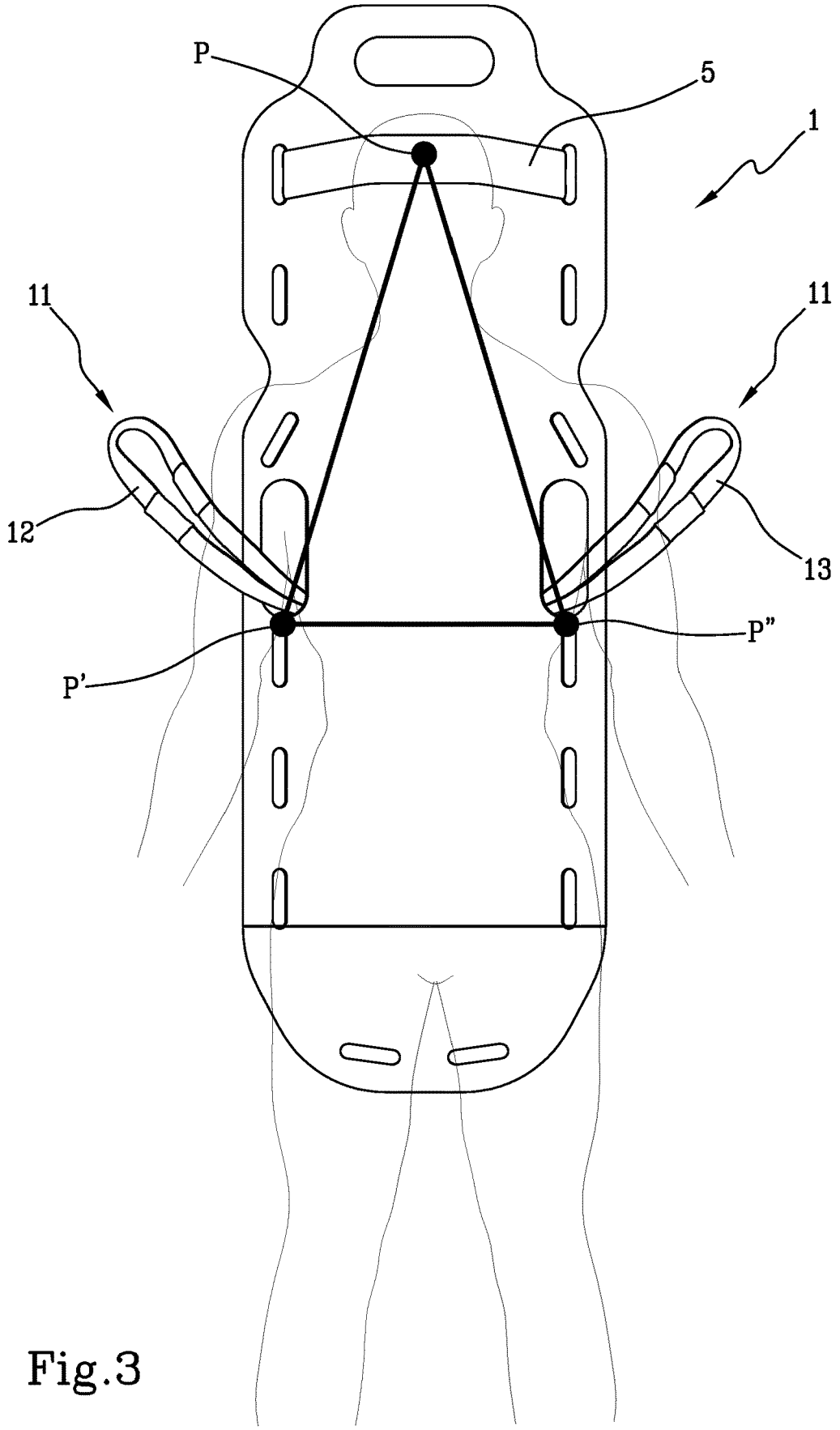
FIG. 3 is a schematic view illustrating the operating principle of the spinal immobilization board of FIGS. 2 and 3.

In accordance with a possible embodiment, illustrated for example in FIG. 2, the floating means 15 comprises inflatable portions 17. The inflatable portions 17 are associated with the support body 2 so as to promote the floating of a person rescued in water.

In particular, the inflatable portions can be of the self-inflating type or be inflated by using external supports, for example cylinders containing compressed gas.

The inflatable portions 17 can comprise an inflatable upper portion 17*a* configured to wrap the head of the person and/or a central inflatable portion 17*b*, preferably connected to the anchoring belt 9, configured to wrap the torso of the person.

Advantageously, the inflatable portions 17 facilitate the breathing of the person, by contributing to keep his or her head above the water level.

The board 1 further comprises an ischiatic support 18 adapted to support the person in a handling condition and active on a portion of the board 1 near the pelvic zone of the person.

The ischiatic support 18 preferably has a first end portion 18*a* connectable to the anchoring belt 9 and a second end portion 18*b* connected by a shape coupling to a lower portion of the support body 2.

As illustrated in the appended figures, the ischiatic support 18 comprises a gripping portion 19 adapted to be grasped by a user during the handling condition of the board 1.

Furthermore, the ischiatic support 18 comprises two support portions 20 adapted to insertingly receive the hands of the rescued person to prevent them from accidently undergoing torsion or injuries during the above-mentioned handling.

During use, the rescued person is positioned with his or her back resting on the support body 2 and his or her head resting on the padded portion 4. The body of the rescued person is constrained to the board by means of the anchoring belt 9, the apical anchoring strap 5 and the ischiatic support 18 in such a way as to maintain the alignment of head, neck and torso.

Once the person has been secured, a first rescuer and a second rescuer respectively grasp a handle 12, 13 and either the upper slot 3 or the gripping portion 19 to carry out handling of the board 1 while maintaining a high degree of safety for the rescued person.

It may be observed, therefore, that the present invention achieves the proposed objects thanks to a spinal immobilization board comprising a first and a second lifting handle arranged in a respective perimeter portion of the board and extending outwardly from of the board so that they are active on a portion of the board near the armpits of the person in a handling condition.

Advantageously the lifting handles facilitate handling of the spinal board, maintaining the positioning of the person on the board unchanged.

Advantageously, the floating means increases the degree of safety of rescue operations in water.

Advantageously, moreover, the apical anchoring strap does not induce torsional stresses on the head of the person, thus safeguarding his or her clinical conditions.

Furthermore, very advantageously, the ribbon-shaped element indicates the state of tension to which the head of the person is subjected under the action of the apical anchoring strap, thus enabling the rescuer to loosen or tighten it in order to reach the optimal configuration.

The invention claimed is:

1. An extrication board comprising:

a support body adapted to support the torso and the head of a person, the support body having a receiving surface on which a person lies in an extrication condition of the board;

at least one apical anchoring strap configured to immobilize the head of the person and defining a first locking point located on the body of the person;

a gripping means comprising a first and a second lifting handle, said first and second lifting handle being arranged in a respective perimeter portion of said board and extending outwardly from said receiving surface of the board; wherein said first and second lifting handles are active on a portion of said board adapted to be positioned on the armpits of the person in said extrication condition of the board and define respectively a second and a third locking point located on the armpits of the person; said first and second lifting handles are configured to be pulled along the board towards the apical anchoring strap so that when the lifting handles are pulled towards the apical anchoring strap each handle defines a restraint for a respective armpit in said extrication condition of the board;

said first, second and third locking points being connected together by imaginary straight lines forming, through an intersection thereof, a triangle defining a locking plane of the person in space; said first and second lifting handles being active respectively on said second and third points so as to secure the body of the person.

2. The board according to claim 1, further comprising an anchoring belt configured to wrap the torso of the person.

3. The board according to claim 2, wherein said at least one apical anchoring strap and/or said anchoring belt have a respective connecting means adapted to connect said at least one apical anchoring strap and/or said anchoring belt to said support body.

4. The board according to claim 3, wherein said support body has at least one coupling seat and in which said connecting means comprises at least one buckle adapted to engage reversibly in said coupling seat to define a shape coupling.

5. The board according to claim 2, wherein said gripping means is connected to said anchoring belt.

6. The board according to claim 5, wherein each of said first and second lifting handles is connected to the anchoring belt, which, in one configuration of use of the board in which the anchoring belt is closed, lies inside the board itself.

7. The board according to claim 6, wherein each of said first and second lifting handles is connected to the anchoring belt in a portion of the anchoring belt configured to wrap the torso of the person.

8. The board according to claim 5, wherein each of said first and second lifting handles is connected to the anchoring belt in such a way as to be arranged, in the extrication condition, transversal to the anchoring belt.

9. The board according to claim 5, wherein said anchoring belt and each of said first and second lifting handles comprise respective reversible coupling means so as to define at least one extended dimension condition, wherein said first and second lifting handles are detached from the anchoring belt, and a reduced dimension condition of said first and second lifting handles, wherein said first and second lifting handles are retained on the anchoring belt.

10. The board according to claim 1, wherein said at least one apical anchoring strap is elastic, which is reversibly configurable between a rest configuration and an elongated configuration, and comprising at least one ribbon-shaped element connected to a portion of said at least one apical anchoring strap to form a gripping element, preferably a slot, for a user.

11. The board according to claim 10, wherein said ribbon-shaped element and said apical anchoring strap are operationally connected so as to indicate a state of tension of said apical anchoring strap.

12. The board according to claim 11, wherein said ribbon-shaped element is secured at a first and a second end to said apical anchoring strap by respective rows of stitches perpendicular to the elongation direction of said apical anchoring strap and arranged at a preset distance in the rest configuration so that a variation of the configuration of said apical anchoring strap causes a variation of said distance.

13. The board according to claim 1, comprising a padded portion adapted to receive restingly a portion of the body of a user and comprising a tear-off connecting means that is active between said at least one apical anchoring strap and said padded portion so as to connect said padded portion to said board.

14. The board according to claim 1, comprising a floating means adapted to generate a hydrostatic thrust that is greater than the weight of said board, so as to promote floating of the board in water.

15. The board according to claim 14, wherein said floating means comprises inflatable portions associated with the support body, an upper inflatable portion configured to wrap the head of the person and/or a central inflatable portion configured to wrap the torso of the person.

16. The board according to claim 1, wherein said support body (2) comprises an upper slot defining a grip for transporting and facilitating the handling of said board.

17. The board according to claim 2, comprising an ischiatic support having a first end portion that is connectable to said anchoring belt and a second end portion connected by a shape coupling to a lower portion of the support body; wherein said ischiatic support is adapted to support a person and is active on a portion of said board near the pelvic zone of the person.

18. The board according to claim 17, wherein said ischiatic support comprises a gripping portion graspable by a user in a board handling condition.

* * * * *